United States Patent [19]

Kohlhage et al.

[11] 3,967,715

[45] July 6, 1976

[54] INTERMITTENT DRIVE SYSTEM FOR TYPEWRITERS

[75] Inventors: Hermann Kohlhage, Paderborn; Manfred Link, Nurnberg, both of Germany

[73] Assignee: Triumph Werke Nurnberg A.G., Nurnberg, Germany

[22] Filed: May 8, 1975

[21] Appl. No.: 575,790

[30] Foreign Application Priority Data

May 27, 1974 Germany ..... 2425527

[52] U.S. Cl. ..... 197/16; 74/112; 197/18

[51] Int. Cl.[2] ..... B41J 23/08

[58] Field of Search ..... 197/16, 17, 18, 12; 74/112, 125, 125.5

[56] References Cited

UNITED STATES PATENTS

| | | | |
|---|---|---|---|
| 1,732,155 | 10/1929 | Egli | 197/17 |
| 3,168,839 | 2/1965 | Chvatlinsky | 197/17 X |
| 3,239,049 | 3/1966 | Voit | 197/17 X |
| 3,268,049 | 8/1966 | Krauss et al. | 197/17 |
| 3,495,693 | 2/1970 | Limberger | 74/112 X |
| 3,715,021 | 2/1973 | Caspari | 197/16 X |
| 3,720,297 | 3/1973 | Frechette | 197/17 |
| 3,724,630 | 4/1973 | Manson | 197/16 X |
| 3,876,054 | 4/1974 | Madison | 197/65 X |

*Primary Examiner*—Edgar S. Burr
*Assistant Examiner*—Paul T. Sewell
*Attorney, Agent, or Firm*—Arthur Gershman

[57] ABSTRACT

An intermittent drive for a single-element printing typewriter, calculator or similar machine. The drive comprises a drive shaft couplable via a cycle clutch to a driven shaft and a governor disposed on the driven shaft to couple it with and maintain it at the same speed as the drive shaft during the clutch cycle. The governor comprises a friction wheel having a generally circular cross-section provided with flattened portions. During the clutch cycle, when the clutch engages the driven shaft, the friction wheel contacts a roll fixed to the drive shaft preventing the driven shaft from leading the drive shaft in response to reflected forces. At the end of the clutch cycle, when the clutch is disengaged, the friction wheel has rotated so that a flattened portion of the friction wheel faces the roll, and driven shaft is free from the rotation of the drive shaft.

6 Claims, 2 Drawing Figures

INTERMITTENT DRIVE SYSTEM FOR TYPEWRITERS

BACKGROUND

This invention relates to an intermittent drive for typewriters, calculators or similar machines, and more particularly to the drive for machines having a single-element type carrier.

To obtain good quality printing in typewriters, calculators or similar machines, all printing parts must be properly synchronized throughout the printing cycle. Since some parts must move relative to other parts to which they are mechanically linked, reflected forces generated by the relative motion must be controlled or limited so as not to interfere with the synchronization.

One known drive employs a continuously rotating drive part which intermittently engages a driven part by means of a wrap spring clutch. The drive is provided with a friction brake such as that disclosed in German publication DT-AS 1,802,486, to Rolf Moritz, in order to control inertial forces developed by the driven part.

A major drawback of this drive is its inability to control forces which are reflected back through the driven part while the clutch is engaged. Since the wrap spring clutch is a one-way clutch, when it is engaged forces which are reflected back from the driven part to the drive part are not transmitted to or braked by the drive part, and the driven part momentarily leads the drive part, resulting in a lack of synchronization. The driven part is particularly susceptible to reflected forces when the driven part is required to transmit multiple forces, such as when the driven part simultaneously triggers two synchronized cams which present identical profiles, which are disposed at 180° with respect to each other, and which transmit motion in the same direction.

Other drawbacks of the drive described in the Moritz publication are its large size, multiplicity of parts and high cost.

SUMMARY OF THE INVENTION

Briefly stated, the invention of an intermittent drive for a single-element printing typewriter, calculator or similar machine comprises a drive shaft couplable via a cycle clutch to a driven shaft and governor means disposed on the driven shaft to couple it with and maintain it at the same speed as the drive shaft during the clutch cycle. The governor means comprises a friction wheel having a generally circular cross-section provided with flattened portions. During the clutch cycle, when the clutch engages the driven shaft, the friction wheel contacts a roll fixed to the drive shaft, preventing the driven shaft from leading the drive shaft in response to reflected forces. At the end of the clutch cycle, when the clutch is disengaged, the friction wheel has rotated so that a flattened portion of the friction wheel faces the roll, and driven shaft is free from the rotation of the drive shaft.

OBJECTS OF THE INVENTION

An object of the invention is to prevent reflected forces developed in an intermittent drive for typewriters, calculators or similar machines from causing the driven shaft of the drive from leading the drive shaft during the clutch cycle.

Another object of the invention is to control these reflected forces by means which are inexpensive, have few parts, and which take up little space.

Other objects and many attendant advantages of the present invention will become apparent to those skilled in the art from a reading of the following detailed description taken in conjunction with the accompanying drawing.

DETAILED DESCRIPTION OF THE INVENTION

Figure 1:
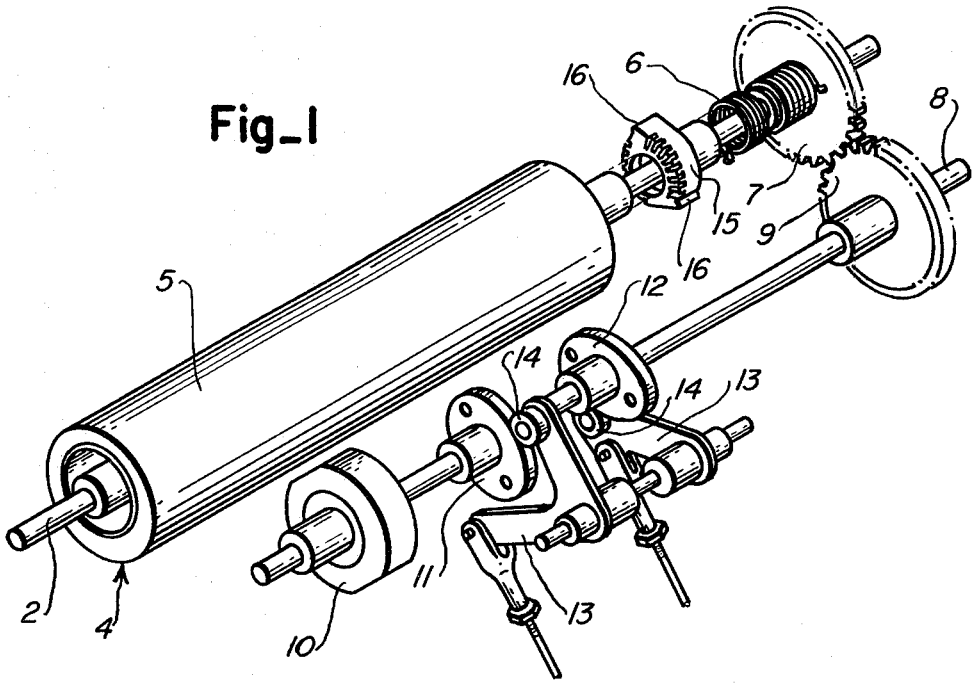
FIG. 1 is a perspective view illustrating a drive mechanism for a single element printer and a friction wheel for selective engagement with a drive-shaft mounted roller in accordance with the invention.
Figure 2:
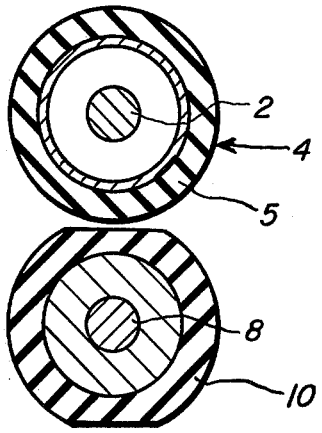
FIG. 2 is a cross-sectional view illustrating the positioning of the friction wheel relative to the drive-shaft mounted roller.

Referring to the Drawing, there is shown in FIG. 1 and FIG. 2 a main drive shaft 2 such as that used by a typewriter, calculator or similar machine, mounted for continuous rotation by an electric motor (not shown). Fixed to the main drive shaft is a roll 4, the surface of which is provided with a rubber coating 5. Also mounted on drive shaft 2 is a normally open or disengaged wrap spring cycle clutch 6, adapted when engaged to couple shaft 2 to a drive gear 7. Clutch 6 is engaged upon release of a clutch actuator 15, normally held arrested by an interposer (not shown) in engagement with a spaced abutment 16 on actuator 15. The interposer reengages a spaced abutment 16 on actuator 15 to disengage the clutch after one cycle. In the embodiment shown in FIG. 1, the clutch actuator 15 has two abutments 16 spaced at 180° to provide two 180° clutch cycles. Clutch actuator 15 may take other configurations, however, where different clutch cycle timing is required.

A driven shaft 8 is disposed parallel to main drive shaft 2. A gear 9 is rigidly fixed to shaft 8 by suitable anti-rotation machine elements and is disposed to mesh with gear 7 to thereby transmit torque from drive shaft 2 to driven shaft 8. Also disposed on driven shaft 8 are a friction wheel 10 and cam plates 11 and 12, all rigidly fixed to the shaft by suitable anti-rotation machine elements. Cam plates 11 and 12 present actuating surfaces for the movement of cam follower arms 13, fixed to rollers 14, to execute certain typewriter functions during the clutch cycle. Cam plates 11 and 12 may be disposed at various angles with respect to one another to impart movement to arms 13 at different timing intervals. For example, as depicted in FIG. 1, the cams are disposed at 90°, although they may be disposed at 180° with respect to one another.

As seen more clearly in FIG. 2, friction wheel 10 is flattened in two places, with the flats staggered at 180°, so that two reduced cross-sectional profiles are provided in these areas. The dimension of roll 4 and the shape and dimension of wheel 10 are such that when the circular portions of wheel 10 face roll 4, wheel 10 is brought into frictional engagement with the roll.

In operation, to print a character, the interposer is disengaged from an abutment 16 to release the clutch 6, starting the clutch cycle, and causing the wrap spring of clutch 6 to wrap around drive shaft 2, engaging gear 7 with the drive shaft. The torque of continuously rotating drive shaft 2 is transmitted through gears 7 and 9 to driven shaft 8. The rotation of shaft 8 throws cam plates 11 and 12, transmitting the appropriate motion through rollers 14 to arms 13 to operate other printing elements.

As driven shaft 8 rotates during the clutch cycle, friction wheel 10, to which it is fixed, also rotates, bringing the circular portion of the periphery of the wheel into frictional engagement with rubber coating 5 of roll 4. Wheel 10 is thus rotated at the same speed as roll 4 and in the opposite direction, and governs the speed of shaft 8. Thus, forces such as those developed during printing which are reflected back to driven shaft 8 through follower arms 13, rollers 14 and cam plates 11 and 12, are prevented by friction wheel 10 from causing driven shaft 8 from leading drive shaft 2.

At the end of the clutch cycle, the interposer arrests an abutment 16, causing clutch 6 to disengage gear 7 from drive shaft 2, and stopping the rotation of friction wheel 10 with one of its flattened portions facing roll 4. Driven shaft 8 is thus free from the rotation of drive shaft 2.

Thus, simple, efficient means have been provided whereby the speed of the driven shaft of a printing mechanism for a typewriter, calculator or similar machine is maintained constant relative to the drive shaft and whereby reflected forces tending to cause the driven shaft to lead the drive shaft are governed.

What is claimed is:

1. Apparatus for cyclically driving a single-element printing mechanism comprising;

a drive shaft;

a driven shaft having means disposed thereon for operating the printing element, a cycle clutch for selectively engaging the drive shaft with the driven shaft, a friction wheel mounted on the driven shaft for maintaining the speed of the driven shaft constant relative to the drive shaft, a roll mounted on the drive shaft for frictional engagement with the friction wheel during the clutch cycle, and wherein said friction wheel is provided with at least one flattened portion disposed at the periphery of the wheel and the wheel is so disposed on the driven shaft that a flattened portion of the wheel faces the roll when the drive shaft is disengaged from the driven shaft.

2. The apparatus of claim 1, wherein two flattened portions are disposed at 180° around the periphery of the wheel.

3. The apparatus of claim 2, wherein the cycle clutch comprises a gear mounted on the drive shaft meshing with another gear mounted on the driven shaft.

4. The apparatus of claim 3, wherein the cycle clutch further comprises a wrap spring clutch disposed on the drive shaft and adapted to disengage the drive shaft from the gear mounted on the drive shaft.

5. The apparatus of claim 4, wherein the means for operating the printing element comprises two cams disposed at 180° with respect to each other.

6. The apparatus of claim 4, wherein the means for operating the printing element comprises two cams disposed at 90° with respect to each other.

* * * * *